United States Patent [19]

Weisfield et al.

[11] 4,126,952

[45] Nov. 28, 1978

[54] ARTISTS' WATER COLOR PAPER STRETCHER AND HOLDER

[75] Inventors: Gayle C. Weisfield, Box 311, Lyle, Wash. 98635; Robert D. Weisfield, Box 311, Lyle, Wash. 98635; Peter Momcilovich, Seattle, Wash.

[73] Assignees: Robert D. Weisfield; Gayle C. Weisfield, both of Lyle, Wash.

[21] Appl. No.: 741,742

[22] Filed: Nov. 15, 1976

[51] Int. Cl.[2] ..... G09F 1/12

[52] U.S. Cl. ..... 40/156

[58] Field of Search ..... 40/156; 38/102, 102.1, 38/102.91; 160/378

[56] References Cited

U.S. PATENT DOCUMENTS

| | | | |
|---|---|---|---|
| 191,795 | 6/1887 | Bowers et al. | 40/152 |
| 1,463,150 | 7/1923 | Carlsen | 40/152 |
| 3,594,939 | 7/1971 | Parker | 40/156 |
| 3,965,599 | 6/1976 | Ebner | 40/152 |
| 3,990,168 | 11/1976 | Murray | 40/152 |

*Primary Examiner*—Louis G. Mancene
*Assistant Examiner*—Wenceslao J. Contreras
*Attorney, Agent, or Firm*—David H. Deits; Roy E. Mattern, Jr.; Kenneth S. Kessler

[57] ABSTRACT

An artists' water color paper stretcher and holder receives wet water color painting paper and similar materials to hold the paper and thereby to cause its stretching during drying, and thereafter to continue holding the paper during the artists' water color painting. This stretcher and holder is a flat top surfaced structure having grooves around its perimeter to receive wedges. Water color painting paper, when wet, is placed over the flat top surfaced structure and extended beyond the perimeter grooves. Thereafter the perimeter wedges are pressed into the perimeter grooves carrying the wet water color paper edges into the grooves, thereby snugly fitting the water color paper to the flat surface of the artists' water color paper stretcher and holder. Other features of the overall structure of the artists' water color paper stretcher and holder include, in various embodiments: a selectively reenforcing ribbed bottom with the ribs formed to provide a storage space for painting supplies having a cover; in addition a rearwardly projecting portion of the board such as the rim forms a water tray for soaking the watercolor paper prior to stretching; and after a picture is completed a picture frame is attached by inserting projections on the frame into slots in the wedges and thereafter the artists' water color paper stretcher and holder continues on in service as a display structure.

11 Claims, 5 Drawing Figures

ARTISTS' WATER COLOR PAPER STRETCHER AND HOLDER

BACKGROUND OF THE INVENTION

Water color paper before being used for water color painting must be wetted, then stretched and held till dry, and thereafter still held tightly while the water color artist paints. The process most commonly used today involves soaking the paper in water until it expands, then it is placed over and secured onto a painting board by gum taping its edges to the board. While drying the paper shrinks and thereby creates a taut, smooth water color painting surface. The paper, after it is stretched, remains secured to the board through the completion of the painting. If the paper becomes unsecured while wet and drying it buckles, and becomes wrinkled creating a difficult surface upon which to paint.

The gum-tape used to secure the water color paper is typically 2 inches wide, with 1 inch of width being used to contact the paper and the other 1 inch of width being used to contact the board. Typically the board is made of one-half to three-quarters of an inch thick plywood, and it is sized to be slightly larger than the water color paper to be stretched. Generally if the plywood board is less than one-half inch in thickness it may warp and/or rack with the forces caused by the drying and shrinking of the water color paper. It is not uncommon for the gum-tape to come loose during the drying process or later during the water color painting period. Extreme care was and is required in removing the painting to avoid tearing the water color paper and damaging the painting.

SUMMARY OF THE INVENTION

In contrast to the difficulties encountered in using gum-tape and plywood boards, this artists' water color paper stretcher and holder, preferably molded from plastic materials, receives wet water color painting paper and similar materials to hold the paper during drying and subsequent painting, by employing slotted wedges which are fit into perimeter grooves, with the initially wetted water color paper having its edges pushed down into the perimeter grooves upon pressing the wedges into the perimeter grooves.

The device comprises a flat working surface upon which the painting paper may be laid. A rim surrounds the perimeter of the flat surface defining a groove which bounds the working surface. A plurality of elongated wedges each having a cross-section generally slightly larger than that of the groove fit receivably within the groove. In its preferred form each wedge is hollow having walls which are flexibly attached and extend upward from a base to a top surface having an opening. The opening in the top permits the sides of the wedge to flex inward. When inserted in the groove with the edge of the paper interposed, the wedge surfaces adjacent to the groove walls deflect inwardly to frictionally secure the wedge within the groove without excessive force and also promotes and allows water to run off the central working surface.

The side opposite the working surface is reinforced with a gridwork of stiffening members which prevent deflection of the working surface. The stiffening members define compartments on the back of the board. Individual compartments are usable for storage of brushes, paints, and other materials which are retained by enclosing covers.

A rearward projection of the rim or the back side of the groove surrounds the rear of the board to form a container which will retain water so that the board may be used also as a soaking tank for the paper.

A rim with appendages which are inserted and retained within the openings in the top of the wedge is used to provide a frame for the finished painting. The rim has a decorative face and may retain a protective sheet of glass over the painting. The frame described allows the painting to be displayed without the need for removing it from the board.

The artist's water color paper stretcher and holder in the above described form provides a simple, efficient device for use by the artist for preparing the paper for painting, holding the paper during painting, and thereafter displaying the finished painting. It further provides, in various embodiments, a convenient paper soaking tray and storage for supplies.

DETAILED DESCRIPTION OF THE INVENTION

In preparing to paint a water color picture, an artist prepares the water color paper on which the subject will be painted by soaking it in water so it expands. The wet paper then is affixed to an artist's board having a flat surface. When the paper dries it shrinks and becomes taut and smooth. This "stretching" process is usually carried out using a rectangular wooden board, such as a piece of plywood, and gummed tape. Common problems with using the tape and wooden board are that the tape does not hold securely approximately 50% of the time and the lighter constructed boards tend to warp. The process is awkward and time consuming. If a heavier board is used to avoid the warpage problem then the artist must cope with the more cumbersome heavy board.

The following description relates to an artist's water color paper stretcher and holder which is simple to use, completely effective in securing the paper, does not warp, and may also be used for display of the finished painting. The disclosure is directed to an apparatus for use with water color paper, but the apparatus works equally well with other artist's paper or similar materials which are soaked then stretched. It will also be apparent that the apparatus may be used for mounting materials which do not require any soaking or stretching, but it is most advantageously used where stretching is necessary.

Figure 1:
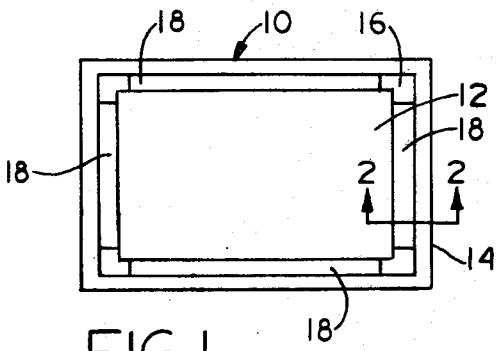
FIG. 1 is a top plan view of the water color paper stretcher and holder.

Referring to FIG. 1, the board 10 has a central surface area 12 on its face which is surrounded by a rim 14. The rim is separated from the central surface by a groove 16. Wedges 18 are inserted in the groove 16 to retain paper 20, which is placed over the central surface 12, by its edges 28.

The central surface should be substantially flat so that the paper 20 placed over it will be smooth. It its preferred form the central surface is flat and rectangular in shape having dimensions from ¾ inch to 1 inch narrower than the artist's paper with which it will be used. This will provide a ⅜ inch to ½ inch overlap of all the edges of the paper over the groove 16.

The groove may be variously shaped but it is preferred that it have inwardly tapered sides 22 and 23 which intersect a flat bottom 24. For example the groove may have a depth of 1 inch below the central surface 12 and the sides have a uniform taper inward of 2½° each.

Figure 2:
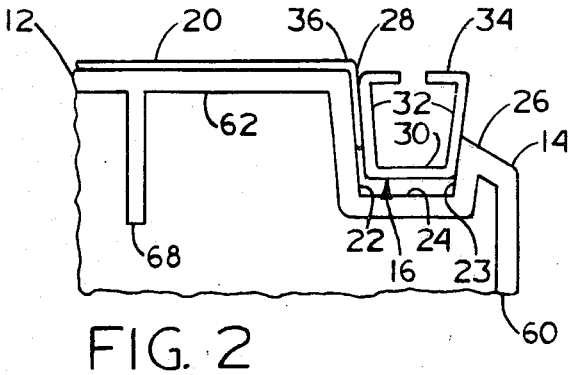
FIG. 2 is a partial section along the line shown in FIG. 1.

The rim also may be variously shaped but it is preferred that it have its top surface 26 below the plane of the central surface 12. This promotes drainage of the water from the central surface and inhibits the tendency of the water that has drained off to wick back on. It is further preferred that this top surface 26 be downwardly sloped on the outside to further promote drainage. See FIG. 2.

The wedges are shaped to fit receivably within the grooves. There may be a single continuous wedge which fits within the groove or, preferably, there are several wedges which are individually inserted in the groove. It is preferred that there be four elongated wedges which can be inserted in the groove with each wedge running substantially the full length of the respective perimeter of the face on which it bounds. The wedge should be narrower at its base than the groove so that the edge 28 of the paper which is drawn into the groove is not crushed to the point of detaching itself from the main body of the paper. It is preferred that the wedge also be tapered as the groove so that, the amount of compression of the edge may be controlled by controlling the depth of insertion of the wedge into the groove. This may also be controlled by the use of a wedge composed of a resilient material. The wedge may have a solid cross-section but it is preferred that it have the hollow cross-section shown in FIG. 2 which is much more effective. In this preferred form the wedge has a base 30 which in use will be approximately parallel to the base 24 of the groove shown in FIG. 2. The sides 32 of the wedge which are opposite each other and which contact the sides 22 and 23 of the groove are flexibly connected to the base 30. Preferably the wedge is made from a plastic material such as rigid polyvinylchloride to provide the flexibility. The top 34 of the wedge, preferably, has an opening or slot to permit the sides 32 of the wedge to be forced together as well as for purposes which will be discussed below. Preferably the wedge is not thicker from top to bottom than the groove is deep so that the top 34 is typically at or below the level of the central surface 12 when in use. This allows for drainage of water and unobstructed access to the perimeter 36 of the paper for painting. The slots also promote and allow for better water drain off. The sides 32 of the wedge when it is undistorted may be tapered variously. For example, for use with a groove having tapered sides of 2½° each the wedge may have sides 32 which have a 2½° taper each on the upper ¼ of the side and a 7½° taper each on the lower ¾. Such a wedge, may have an overall top width dimension which is 9/16 inch where the groove 16 is ½ inch wide at its top as measured by projecting the outer side 23 of the groove to the same level as the inner side 22. Such a wedge; having a height equal to the groove depth, for example 1 inch; will accommodate the typically encountered range of paper weights utilized by artists; up to 300 lb. weight paper. The inwardly flexing sides of the wedge avoid excess pressure on the paper and facilitates removal of the wedge from the groove without tearing the paper. Having the rim 14 lower than the central surface 12 facilitates the compressing and grasping of the wedge for removal.

In the preferred construction of the artist's water color board, the board is made from molded medium or high impact plastic such as high impact polystyrene. This material avoids the warpage problems encountered with wood boards. Other materials such as wood may be used, but the plastic is preferred.

To use the board, the paper is first soaked for 10 to 15 minutes, then placed on the flat central surface 12 with the edges of the sheet overlapping the groove 16 and made smooth. The wedge or wedges are inserted in the groove securely drawing the interposed edge of the paper 28 into the groove. The action of inserting the wedges draws the edge of the sheet downward drawing it tight. The paper is then allowed to dry which causes the sheet of paper to draw taut and smooth. Utilizing the above described board the process of placing the wet paper on the board, smoothing it, and inserting the wedges can be accomplished in less than 3 minutes without the awkward use of tape. Once the paper has been stretched it may then be painted on. The paper is left on the board during painting. After the painting is completed it may remain on the board on which it may be displayed or it may be removed for mounting elsewhere.

Figure 4:
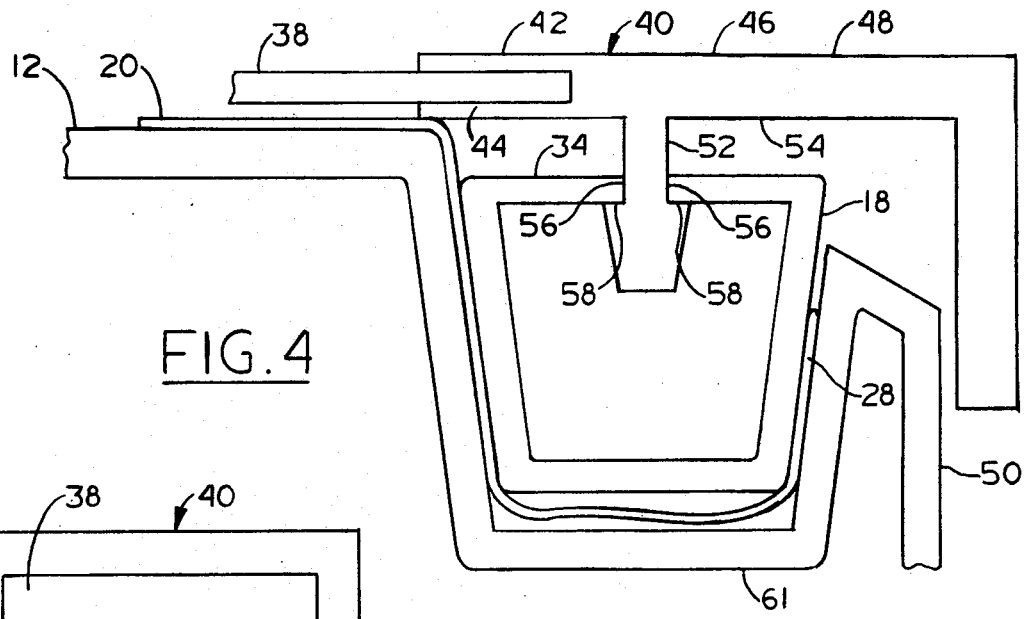
FIG. 4 is a partial section along the line shown in FIG. 3.
Figure 3:
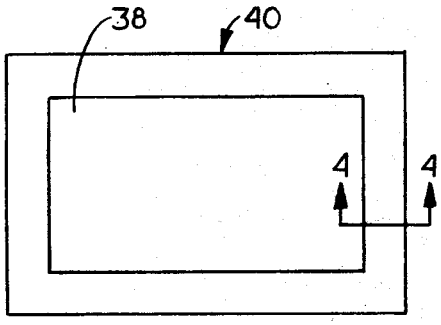
FIG. 3 is a top plan view of the water color paper stretcher and holder with a picture frame structure in position.

When the board is used for display, an attachment for such display is provided. Referring to FIGS. 3 and 4 which show the preferred form of the attachment, a transparent sheet material 38, such as glass, is placed over the painting and retained in position by a holder framework 40. The framework 40 preferably has a pair of lips 42 and 44 on its interior rim which extend over the edge of the glass to secure it from movement. Where the glass contacts the surface of the painting 20 it is only necessary that there be an outer lip 42 to secure the glass. The framework 40 preferably has an ornamental face 46 which has the appearance and performs the same decorative function as a conventional picture frame. It is preferred that the outside edge 48 of the framework 40 extend over the outer side edge 50 of the board. In attaching the framework to the board, it is preferred that the wedges 18 not be removed and that the framework be attached to the wedges. The preferred form of attachment is by an appendage 52 which depends from the rear side 54 of the framework 40. The appendage is inserted into the opening in the top 34 of the wedge to be captively secured for example by the frictional forces of the edges 56 of the slots against the appendage or, preferably, by the use of barbs 58 on the sides of the appendage. The framework may be secured by other methods such as well known mechanical fasteners or by the use of adhesives. It is not necessary that the attachment be to the wedge but may be made to the board itself. The framework may be constructed integrally with a wedge so that when the painting is finished the individual wedges which do not obstruct the painting surface are removed and replaced with the framework and wedge assembly, with or without glass.

In its preferred form the board has a rearwardly projecting portion; such as the portion of the rim 60, preferably, or the rear of the groove 61; which extends beyond the rear surface 62 of the board. This allows the board to be turned face down and filled with water to serve as a tank for soaking the paper. When not in use as a tank this area may be used as a storage area for supplies such as the artist's paper. The supplies, for example the paper, may be retained by a cover, not shown which encloses the rear of the board, or preferably by a cord 64, as shown in FIG. 5, laced between retainers, such as hooks 66.

In its preferred form, the board is reinforced by one or more stiffening members 68. It is preferred that there be a plurality of such stiffening members which intersect forming a gridwork on the rear of the board defining compartments 70. The compartments may have covers so that they may individually be used for storage of supplies; for example, brushes and paints. It is preferred that the stiffening members 68 do not project as far rearward as the rim edge 60; or the rear of the groove 61, if it forms the soaking tray edge; so that the board will still perform its function as a soaking tray and also serve as a storage area for paper. To facilitate the removal of supplies, the rear storage compartments 70 may themselves act as retainers for removable storage boxes 72 which contain the supplies. The boxes 72 may be retained in the compartments by the use of spring clips, not shown, or any other conventional method. A cover 74 is preferably provided to enclose the box.

Figure 5:
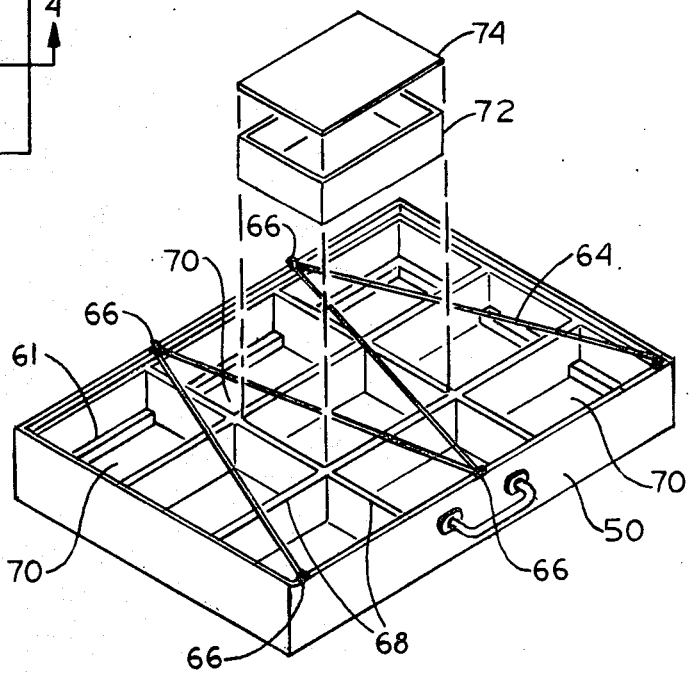
FIG. 5 is a perspective view of the rear of the water color paper stretcher illustrating, among other things, the storage and soaking tray features.

A handle 76, as shown in FIG. 5, may be attached to the edge of the board for ease of handling during transportation.

A cover may be provided to enclose the face 12 of the board to protect the board and any paper mounted thereon.

We claim:

1. An artist's water color paper stretcher and holder, comprising:

(a) a board having a substantially flat central surface and a surrounding rim defining a groove along the perimeter of the flat surface; and (b) a wedge having a base, opposite sides which are flexibly dependent from the base at an angle to form a taper, and a top opposite the base having an opening to permit the sides to be forced inwardly to receivably engage in the groove so that when wet paper is placed on the central surface with its edges extending over the groove the wedge may be inserted in the groove to secure the paper to the board during drying and thereafter.

2. An artist's water color paper stretcher and holder, as claimed in claim 1, comprising, in addition: a transparent sheet material covering the central flat surface; and a holder framework attached to the wedge having an appendage for captive engagement in the opening in the top of the wedge and an interior rim for retaining the transparent sheet material in position over the central flat surface so that a picture painted on a paper stretched on the board may be displayed permanently on the same board.

3. An artist's water color paper stretcher and holder, as claimed in claim 2, wherein the holder has an ornamental face so that a decorative frame for the picture is formed.

4. An artist's water color paper stretcher and holder, as claimed in claim 2, wherein the appendage has a barb to prevent withdrawal of the appendage from the opening.

5. An artist's water color paper stretcher and holder, as claimed in claim 1, wherein the rim is below the level of the central flat surface.

6. An artist's water color paper stretcher and holder, as claimed in claim 5, wherein the rim is sloped outwardly to further promote water drainage.

7. An artist's water color paper stretcher and holder, as claimed in claim 1, having a portion thereof which projects rearwardly to define a tray on the rear of the board which will retain water for use in soaking paper prior to stretching.

8. An artist's water color paper stretcher and holder, as claimed in claim 7, wherein the rearwardly projecting portion is formed by the rim.

9. An artist's water color paper stretcher and holder, as claimed in claim 1, wherein there are a multiplicity of stiffening members opposite the flat central surface which form a gridwork defining a compartment on the rear of the board and comprising in addition a cover for enclosing the compartment to provide storage for artist's supplies.

10. An artist's water color paper stretcher and holder, comprising:

(a) a board having a substantially flat central surface; a surrounding rim defining a groove along the perimeter of the flat surface, having a portion thereof which extends rearwardly to define a tray on the rear of the board which will retain water for use in soaking paper prior to stretching, and having a top surface below the level of the central flat surface which is outwardly sloped to promote water drainage; and a multiplicity of stiffening members opposite the flat central surface which form a gridwork defining a compartment on the rear of the board;

(b) a cover for enclosing the compartment to provide a storage for artists' supplies; and (c) a plurality of wedges each having a base, opposite sides which are flexibly dependent from the base at an angle to form a taper, and a top opposite the base having a slot to permit the sides to be forced inwardly to receivably engage in the groove so that when wet paper is placed on the central surface with its edges extending over the groove the wedges may be inserted to secure the paper to the board during drying and thereafter.

11. An artist's water color paper stretcher and holder comprising:

(a) a board having a substantially flat central surface and a surrounding rim defining a groove, having tapered sides, along the perimeter of the flat surface and wherein the sides of the groove have a $2\frac{1}{2}°$ taper; and (b) a wedge having a base, opposite sides which are flexibly dependent from the base at an angle to form a taper, and a top opposite the base having an opening to permit the sides to be forced inwardly to receivably engage in the groove so that when wet paper is placed on the central surface with its edges extending over the groove the wedge may be inserted in the groove to secure the paper to the board during drying and thereafter.

* * * * *